US007920813B2

(12) United States Patent
Inada et al.

(10) Patent No.: US 7,920,813 B2
(45) Date of Patent: Apr. 5, 2011

(54) IMAGE-FORMING APPARATUS EQUIPPED WITH INTERMEDIATE TRANSFER MEMBER

(75) Inventors: Yasuyuki Inada, Toyokawa (JP); Tomohide Mori, Okazaki (JP); Toshiaki Hiroi, Toyokawa (JP)

(73) Assignee: Konica Minolta Business Technologies, Inc., Chiyoda-Ku, Tokyo (JP)

( * ) Notice: Subject to any disclaimer, the term of this patent is extended or adjusted under 35 U.S.C. 154(b) by 499 days.

(21) Appl. No.: 12/128,942

(22) Filed: May 29, 2008

(65) Prior Publication Data

US 2008/0310890 A1 Dec. 18, 2008

(30) Foreign Application Priority Data

Jun. 15, 2007 (JP) ..... 2007-158461

(51) Int. Cl.
*G03G 15/01* (2006.01)
*G03G 15/14* (2006.01)
*G03G 15/16* (2006.01)

(52) U.S. Cl. ..... 399/302; 399/308

(58) Field of Classification Search ..... 399/297, 399/302, 308
See application file for complete search history.

(56) References Cited

U.S. PATENT DOCUMENTS

| | | | | |
|---|---|---|---|---|
| 5,701,568 | A * | 12/1997 | Hiroshima et al. | 399/302 |
| 6,226,465 | B1 | 5/2001 | Funatani | |
| 7,560,209 | B2 * | 7/2009 | Tokutake et al. | 430/66 |
| 7,824,760 | B2 * | 11/2010 | Mochizuki et al. | 428/200 |
| 2004/0126125 | A1 | 7/2004 | Yoda et al. | |
| 2005/0196196 | A1 * | 9/2005 | Ota et al. | 399/159 |
| 2005/0201775 | A1 * | 9/2005 | Ikeda | 399/101 |
| 2005/0207788 | A1 * | 9/2005 | Bandou et al. | 399/159 |
| 2006/0083558 | A1 * | 4/2006 | Tomizawa | 399/302 |
| 2006/0099014 | A1 | 5/2006 | Yoshida | |
| 2007/0065607 | A1 | 3/2007 | Kurachi et al. | |

FOREIGN PATENT DOCUMENTS

| | | | |
|---|---|---|---|
| JP | 01-280783 | | 11/1989 |
| JP | 6-317992 | A | 11/1994 |
| JP | 2004-117722 | | 4/2004 |
| JP | 2005-128243 | | 5/2005 |
| JP | 2006-113284 | A | 4/2006 |
| JP | 2007086734 | A * | 4/2007 |
| JP | 2007-114754 | | 5/2007 |
| WO | WO 2007046218 | A1 * | 4/2007 |

OTHER PUBLICATIONS

European Search Report in Application No. 08010121.5-2209, dated Oct. 22, 2008.
Notification of Reasons for Refusal in JP 2007-158461 dated Jun. 2, 2009, and an English Translation thereof.

* cited by examiner

*Primary Examiner* — David M Gray
*Assistant Examiner* — Fred Braun
(74) *Attorney, Agent, or Firm* — Buchanan Ingersoll & Rooney PC

(57) ABSTRACT

An image-forming apparatus, including:
a latent-image supporting member, and
an intermediate transfer member that supports a toner image primarily-transferred thereon from the latent-image supporting member, secondarily-transfers the supported toner image onto an image receiving medium, and has a hard releasing layer on the surface thereof, and a ratio Rv (Vbt/Vpc) between a surface moving speed Vbt of the intermediate transfer member and a peripheral speed Vpc of the latent-image supporting member satisfies the following relational expression:

$$-5\times10^{-6}\times Hu+1.0087 \leqq Rv \leqq -5\times10^{-6}\times Hu+1.0167$$

wherein Hu is a universal hardness (N/mm$^2$) of the surface of the intermediate transfer member, and is set to 220 N/mm$^2$ or more.

13 Claims, 7 Drawing Sheets

IMAGE-FORMING APPARATUS EQUIPPED WITH INTERMEDIATE TRANSFER MEMBER

This application is based on application No. 2007-158461 filed in Japan, the contents of which are hereby incorporated by reference.

BACKGROUND OF THE INVENTION

1. Field of the Invention

The present invention relates to an image-forming apparatus, such as a mono-chrome/full-color copying machine, a printer, a facsimile and a composite machine thereof.

2. Description of the Related Art

In an image-forming apparatus of an intermediate transfer system in which toner images of respective colors, formed on latent-image supporting members, are respectively primary-transferred, and superposed on an intermediate transfer member, and then secondary-transferred onto a image receiving medium at one time, such an image-forming apparatus which uses an intermediate transfer member having a hard releasing layer formed on the surface thereof so as to improve the releasing property to the toner, in order to improve the secondary transferring rate, has been proposed. With this arrangement, it becomes possible not only to improve the image quality, but also to reduce residual toner after the secondary-transferring process (waste toner) remaining on the intermediate transfer member after the secondary-transferring process; thus, it becomes possible to reduce the amount of waste toner to be discharged, and consequently to reduce the environmental load as well as loads imposed on the user, such as exchanging operations of waste-toner recovery containers.

In the above-mentioned image-forming apparatus, however, upon primary-transferring a toner image, formed on the latent-image supporting member, onto the intermediate transfer member, the toner image is sandwiched between the latent-image supporting member and the intermediate transfer member to be aggregated under a pressing force to cause a problem of occurrence of a void image. More specifically, as shown in FIG. 9, one portion 101 of the aggregated toner comes to have an increased adhesion strength to the latent-image supporting member 103 rather than to the intermediate transfer member having a higher releasing property, and is not primary-transferred to remain on the latent-image supporting member 103. In particular, in the center portion of a character image and a fine line image where a pressing force becomes higher to increase the toner aggregating force, the occurrence of a void image becomes conspicuous.

In the case when there is a temperature rise in the machine due to continuous printing operations or the like, components contained in the developer tend to easily adhere to the intermediate transfer member. Even in such a state, the adhered matter can be scraped together with toner by a cleaning blade or the like in the case of a small number of printing operations; however, when printing operations are continuously carried out, the components of the developer are kept adhering to the intermediate transfer member, with the result that the adhered matter is no longer scraped by the cleaning blade or the like to cause filming on the surface of the intermediate transfer member. The filming causes reduction in image quality and damage in the cleaning blade edge portion, resulting in insufficient cleaning.

In order to prevent occurrences of a void image and filming, it has been proposed that a speed difference is prepared between peripheral speeds of the intermediate transfer member and the latent-image supporting member (Patent Documents 1 and 2). However, this method tends to cause scratches on the intermediate transfer member and the latent-image supporting member, resulting in a new problem of degradation in image quality. This method fails to prevent filming sufficiently.

[Patent Document 1] Japanese Patent Application Laid-Open No. 6-317992

[Patent Document 2] Japanese Patent Application Laid-Open No. 2006-113284

BRIEF SUMMARY OF THE INVENTION

The object of the present invention is to provide an image-forming apparatus which can provide an image without a void image while improving a secondary transferring rate, and restrain filming on an intermediate transfer member, insufficient cleaning and surface scratches on the intermediate transfer member and the latent-image supporting member.

The present invention provides an image-forming apparatus, which comprises an intermediate transfer member that supports a toner image primarily-transferred thereon from a latent-image supporting member, and secondarily-transfers the supported toner image onto a image receiving medium, wherein the intermediate transfer member has a hard releasing layer on the surface thereof, and a ratio Rv (Vbt/Vpc) between a surface moving speed Vbt of the intermediate transfer member and a peripheral speed Vpc of the latent-image supporting member satisfies the following relational expression:

$$-5\times10^{-6}\times\mathrm{Hu}+1.0087\leqq Rv\leqq-5\times10^{-6}\times\mathrm{Hu}+1.0167$$

wherein Hu is a universal hardness ($N/mm^2$) of the surface of the intermediate transfer member, and is set to 220 $N/mm^2$ or more.

DETAILED DESCRIPTION OF THE INVENTION

The present invention relates to an image-forming apparatus, which is provided with an intermediate transfer member that supports a toner image primary-transferred thereon from a latent-image supporting member, and secondary-transfers the supported toner image onto an image receiving medium, and in this structure, wherein the intermediate transfer member has a hard releasing layer formed on the surface of the intermediate transfer member, and a ratio Rv (Vbt/Vpc) between a surface moving speed Vbt of the intermediate transfer member and a peripheral speed Vpc of the latent-image supporting member satisfies the following relational expression:

$$-5\times10^{-6}\times Hu+1.0087 \leqq Rv \leqq -5\times10^{-6}\times Hu+1.0167$$

wherein Hu is a universal hardness ($N/mm^2$) of the surface of the intermediate transfer member, and is set to 220 $N/mm^2$ or more.

The image-forming apparatus of the present invention makes it possible to provide an image without a void image while improving a secondary transferring rate, and also to restrain filming on an intermediate transfer member, insufficient cleaning and surface scratches on the intermediate transfer member and the latent-image supporting member.

An image-forming apparatus in accordance with the present invention is provided with an intermediate transfer member that supports a toner image primary-transferred from a latent-image supporting member, and secondary-transfers the supported toner image onto a image receiving medium. The following description will discuss the image-forming apparatus of the present invention by exemplifying a tandem-type full-color image-forming apparatus having latent-image supporting members for respective developing units of respective colors, each of which forms a toner image on the latent-image supporting member; however, any apparatus having any structure may be used as long as it has a specific intermediate transfer member and a predetermined speed difference being set between the intermediate transfer member and the latent-image supporting member, and, for example, a four-cycle full-color image-forming apparatus, which has developing units of respective colors for a single latent-image supporting member, may be used.

Figure 1:
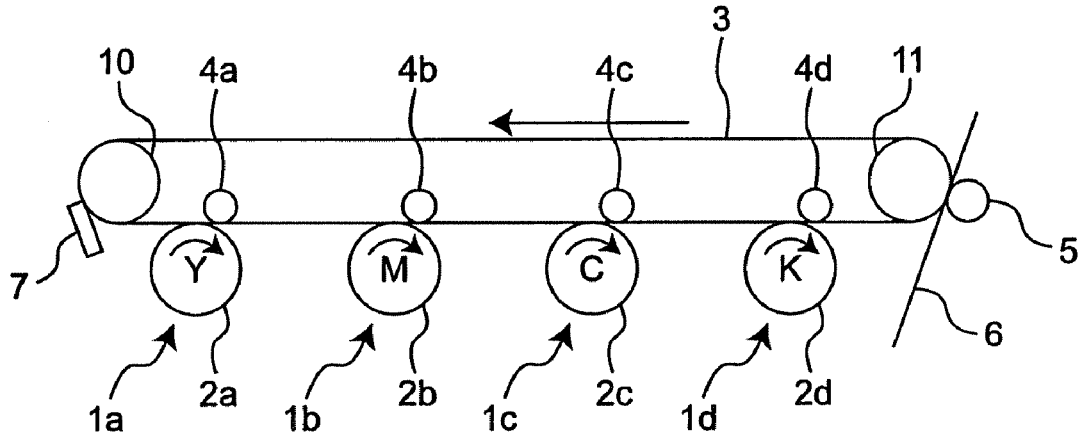
FIG. 1 is a schematic diagram that shows one example of an image-forming apparatus in accordance with the present invention.

FIG. 1 is a schematic diagram that shows one example of an image-forming apparatus of the present invention. In a tandem-type full-color image-forming apparatus of FIG. 1, each of developing units (1*a*, 1*b*, 1*c* and 1*d*) is normally provided with at least a charging device, an exposing device, a developing device, a cleaning device and the like (none of which are shown) that are placed around each of latent-image supporting members (2*a*, 2*b*, 2*c* and 2*d*). These developing units (1*a*, 1*b*, 1*c* and 1*d*) are placed in parallel with an intermediate transfer member 3 that is extended by extension rollers (10, 11). Toner images, formed on the surfaces of the latent-image supporting members (2*a*, 2*b*, 2*c* and 2*d*) in the respective developing units, are respectively primary-transferred onto the intermediate transfer member 3 by using primary-transfer rollers (4*a*, 4*b*, 4*c* and 4*d*), and superposed on the intermediate transfer member, so that a full-color image is formed. The full-color image, transferred onto the surface of the intermediate transfer member 3, is secondary-transferred onto a image receiving medium 6 such as paper at one time by using a secondary-transfer roller 5, and then allowed to pass through a fixing device (not shown), so that a full-color image is formed on the image receiving medium. Residual toner after the transferring process, left on the intermediate transfer member, is removed by a belt cleaning device 7.

The latent-image supporting members (2*a*, 2*b*, 2*c* and 2*d*) are so-called photosensitive members on which toner images are formed based upon electrostatic latent images formed on the surfaces thereof. With respect to the latent-image supporting member, not particularly limited as long as it can be installed in a conventional image-forming apparatus, the one having an organic-based photosensitive layer is normally used. The latent-image supporting member is rotated in such a manner that its surface is allowed to move in the same direction as that of the intermediate transfer member at the contact portion with the intermediate transfer member. Not particularly limited, the surface hardness of the latent-image supporting member is normally set, for example, in the range from 150 to 500 $N/mm^2$ in universal hardness, which will be described later.

In the present invention, the intermediate transfer member 3 has a hard releasing layer on its surface, and a ratio Rv (Vbt/Vpc) between a surface moving speed Vbt of the intermediate transfer member and a peripheral speed Vpc of the latent-image supporting member satisfies the following relational expression:

$$-5\times10^{-6}\times Hu+1.0087 \leqq Rv \leqq -5\times10^{-6}\times Hu+1.0167 \quad (A),$$

preferably $$-1.5\times10^{-6}\times Hu+1.0103 \leqq Rv \leqq -5\times10^{-6}\times Hu+1.0167 \quad (B),$$

(in the expression, Hu is a universal hardness ($N/mm^2$) of the surface of the intermediate transfer member, and is set to 220 $N/mm^2$ or more, particularly in the range from 220 to 1700 $N/mm^2$, and preferably in the range from 220 to 1100 $N/mm^2$ or more. The values of "$-5\times10^{-6}$" and "$-1.5\times10^{-6}$" in the expression mean a conversion factor respectively that relates Hu to Rv on the basis of the results of the experiments and has a unit of $mm^2/N$).

Figure 2:
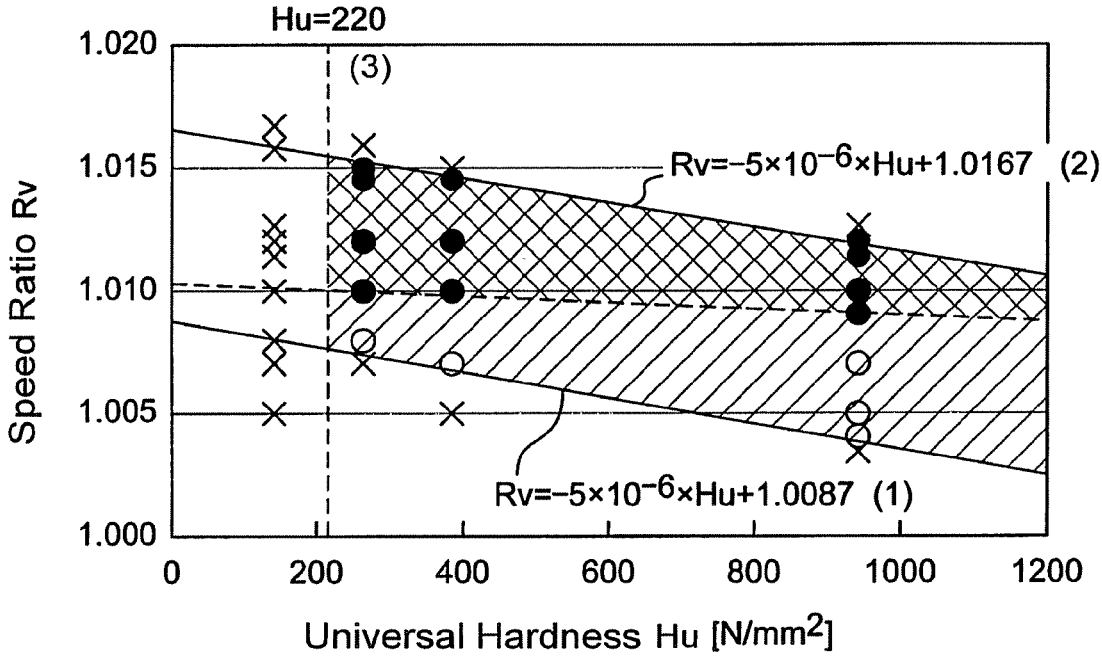
FIG. 2 is a graph that shows the relationship between a speed ratio Rv and a hardness Hu specified by the present invention.

The relational expression (A) to be satisfied by the ratio Rv is indicated by an area having slanting lines in FIG. 2. In FIG. 2, the area having slanting lines represents a setting available area of the ratio Rv and the hardness Hu that satisfy the relational expression (A). The surface moving speed Vbt of the intermediate transfer member, the peripheral speed Vpc of the latent-image supporting member and the hardness Hu of the surface of the intermediate transfer member are properly selected in a manner so as to position plots of the speed ratio Rv and the hardness Hu of the surface of the intermediate transfer member within the area having slanting lines. Thus, the secondary transferring rate is improved, and it becomes possible to restrain problems, such as a void image, filming, insufficient cleaning and surface scratches on the intermediate transfer member and the latent-image supporting member. In FIG. 2, for convenience of explanation, although Hu is shown only within the range of 1200 $N/mm^2$ or less, it is supposed that the area having slanting lines exists even in the range having Hu exceeding 1200 $N/mm^2$. Normally, the area having slanting lines is located up to a range in which Hu is 1700 $N/mm^2$ or less. In the case when the plots of the ratio Rv and the hardness Hu are located in an area below the straight line (1) in FIG. 2, filming occurs on the surface of the intermediate transfer member, resulting in the subsequent insufficient cleaning. In the case when the plots thereof are located in an area above the straight line (2), scratches occur on the surfaces of the intermediate transfer member and the latent-image supporting member, resulting in degradation in image quality. In the case when the plots thereof are located in an area on the left side from Hu=220 (that is, a straight line (3) in FIG. 2), the secondary transferring rate is lowered to cause a reduction in image density.

The relational expression (B) to be satisfied by the ratio Rv is indicated by a net-patterned area in FIG. 2. In FIG. 2, the net-patterned area represents a setting available area of the ratio Rv and the hardness Hu that satisfy the relational expression (B). By selecting the surface moving speed Vbt of the intermediate transfer member, the peripheral speed Vpc of the latent-image supporting member and the hardness Hu of the surface of the intermediate transfer member so as to position plots of speed ratio Rv and the hardness Hu of the surface of the intermediate transfer member within the net-patterned area, the secondary transferring rate is further improved, and it becomes possible to restrain problems, such as a void image, filming, insufficient cleaning and surface scratches on the intermediate transfer member and the latent-image supporting member.

The speed ratio Rv may be controlled by adjusting the number of revolutions of the driving roller (for example, extension roller represented by 11 in FIG. 1) of the intermediate transfer member and the driving motor of the latent-image supporting member (photosensitive member), or may be controlled by changing the numbers of teeth of gears in the driving gear system, or by adjusting the outer diameter of the driving roller or the latent-image supporting member.

In the present specification, with respect to the universal hardness, in the case of the thickness of a hard releasing layer exceeding 1 μm, by pushing a measuring indenter into a measured subject with a load being applied thereto (Indentation), the resulting value obtained from the following equation is used.

Universal hardness=(Test load)/(Contact surface area of indenter to measured subject under test load)

Upon measuring the universal hardness as described above, a commercially available hardness measuring device may be used, and, for example, a hyperfine hardness tester H-100 V (made by Fischer instruments K.K.) may be used to carry out measurements. In this measuring device, an indenter having a pyramid shape or a trigonal pyramid shape is pushed into a measured subject with a test load being applied thereto, and upon reaching a predetermined depth, the surface area of the indenter in which it is made in contact with the measured subject is found from the indentation depth at this time, so that the universal hardness is calculated based upon the above-mentioned equation. The indentation depth is set to 1/10 of the thickness of the hard releasing layer.

When the thickness of the hard releasing layer is 1 μm or less, the value obtained by converting the hardness Hn measured by the nano-indentation method is used as universal hardness. This is because, in the above-mentioned universal hardness measuring method, the indenter penetrates the corresponding layer failing to measure the universal hardness accurately.

The measuring method of the hardness Hn by the use of the nano-indentation method has basically the same system as the above-mentioned universal hardness measuring method, and the indenter is pushed into a measured subject, and the hardness is measured based upon the relationship between the load and the indentation depth at that time. The nano-indentation method is generally used for measuring physical properties of a very thin film (thickness of 1 μm or less). In the measuring process by the nano-indentation method, since a minute diamond indenter is pushed into a measured thin film, the measurements are less subject to the base member properties under the thin film, and cracks hardly occur in the thin film even when the indenter is pushed therein.

Figure 3:
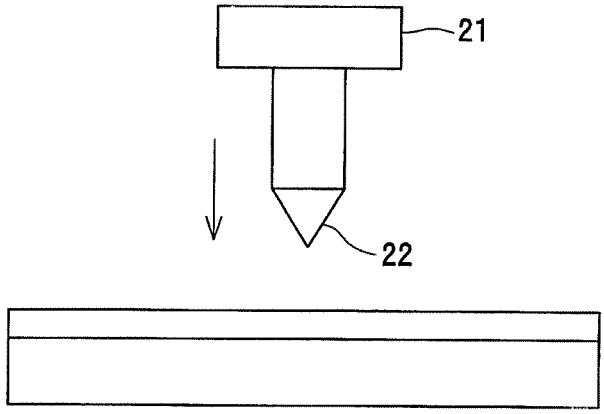
FIG. 3 is a schematic diagram that shows one example of a hardness measuring device in accordance with a nano-indentation method.
Figure 4:
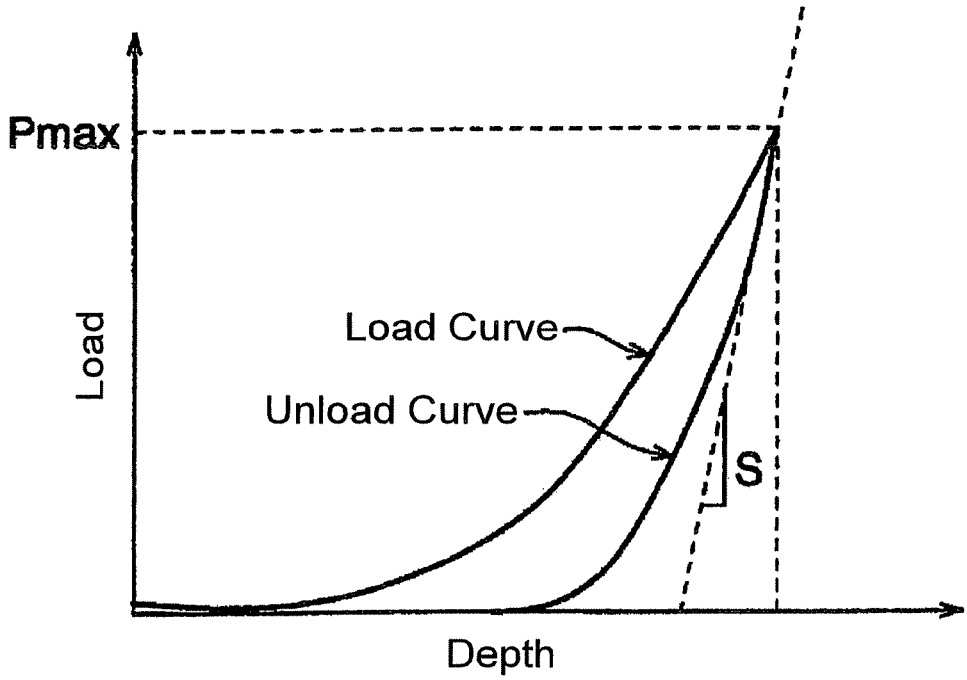
FIG. 4 shows a typical load vs. change curve obtained by the nano-indentation method.
Figure 5:
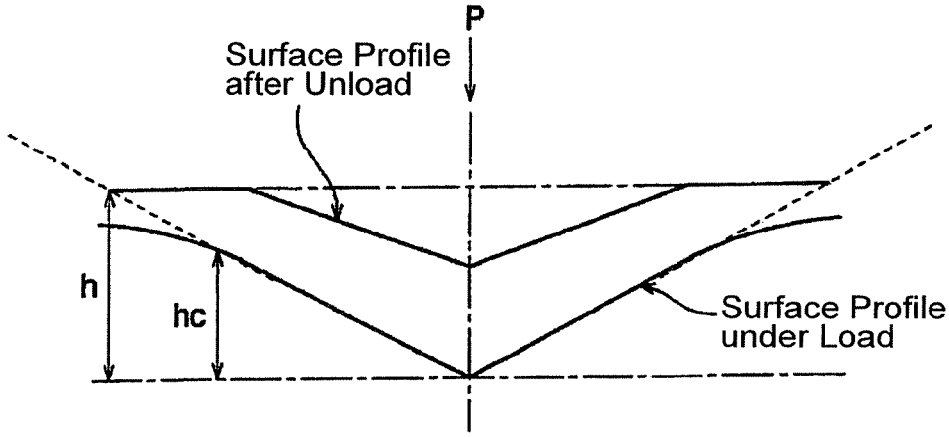
FIG. 5 is a schematic drawing that shows a state in which an indenter and a sample are made in contact with each other in the nano-indentation method.

FIG. 3 shows one example of a measuring device in accordance with the nano-indentation method. In this measuring device, a transducer 21 and a diamond Berkovich indenter 22 having a right triangular shape in its tip shape are used, with a load of the [μN] order being applied, so that an amount of positional change can be measured in precision in the [nm] order. In this measurement, for example, a commercial product, NANO Indenter XP/DCM (made by MTS Systems Co./MTS NANO Instruments) may be used. FIG. 4 shows a typical load-positional change curve obtained by the nano-indentation method. FIG. 5 is a schematic drawing that shows a state in which the indenter and a sample are made in contact with each other.

The hardness Hn is found from the following equation:

$$Hn=P\max/A$$

in which Pmax is the maximum load applied to the indenter, and A is a contact projection area between the indenter and a sample at that time. The contact projection area A is represented by the following equation by using hc in FIG. 5:

$$A=24.5(\mathrm{hc})^2$$

in which hc becomes shallower than the entire indentation depth h due to the elastic concave section on the peripheral surface of the contact point as shown in FIG. 5, and is indicated by the following equation:

$$hc=h-hs$$

in which hs is an amount of the concave caused by elasticity, and represented by the following equation based upon an inclination (inclination S in FIG. 4) of a load curve after the indentation of the indenter and the shape of the indenter:

$$hs=\epsilon\times p/s$$

Here, ϵ is a constant relating to the shape of the indenter, and set to 0.75 for Berbovich indenter.

By multiplying the hardness Hn (GPa) measured by the nano-indentation method as described above by a coefficient 208.9, it can be converted to the universal hardness ($N/mm^2$). For example, a hardness Hn of 4.5 GPa measured by the nano-indentation method can be converted to a universal hardness Hu of 940 $N/mm^2$.

The intermediate transfer member 3 is shown as an intermediate transfer belt in FIG. 1; however, not limited to this shape as long as it has a hard releasing layer on its surface, and, for example, a so-called intermediate transfer drum may be used.

Figure 6:
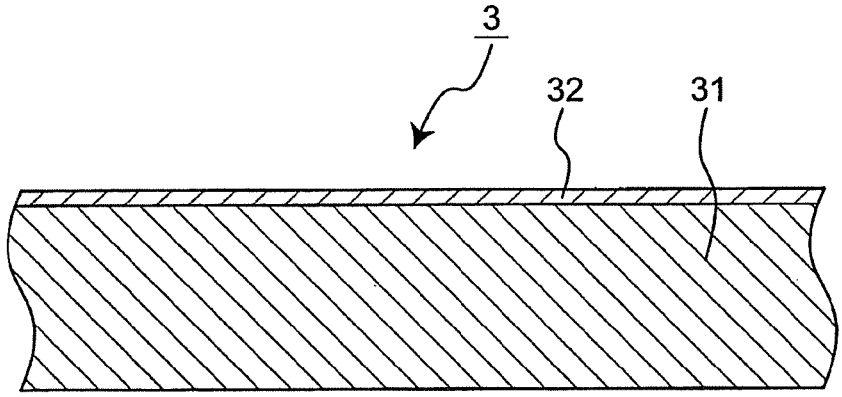
FIG. 6 is a schematic cross-sectional view that shows a layer structure of an intermediate transfer member.

By exemplifying the intermediate transfer member 3 having a seamless belt shape, the following description will discuss the intermediate transfer member of the present invention. FIG. 6 is a schematic cross-sectional view that shows a layer structure of the intermediate transfer belt 3.

The intermediate transfer belt 3 has at least a base member 31 and a hard releasing layer 32 formed on the surface of the base member 31.

Although not particularly limited, the base member 31 is a seamless belt having a volume resistivity in the range from $1\times10^6$ Ω/cm to $1\times10^{12}$ Ω/cm and a surface resistivity in the range from $1\times10^7$Ω/□ to $1\times10^{12}$Ω/□ and is made from a material formed by dispersing a conductive filler such as carbon in the following materials or by adding an ionic conductive material to the following materials: resin materials such as polycarbonate (PC); polyimide (PI); polyphenylene sulfide (PPS); polyamideimide (PAI); fluorine-based resins such as polyvinylidene fluoride (PVDF) and tetrafluoroethylene-ethylene copolymer (ETFE); urethane-based resins such as polyurethane; polyamide-based resins such as nylons, or rubber materials such as ethylene-propylene-diene rubber (EPDM), nitrile-butadiene rubber (NBR), chloroprene rubber (CR), silicone rubber, and urethane rubber. In the case of a resin material, the thickness of the base member is normally set to 50 to 200 μm, and in the case of a rubber material, it is set to 300 to 700 μm.

The intermediate transfer belt 3 may have another layer between the base member 31 and the hard releasing layer 32, and the hard releasing layer 32 is placed as an outermost surface layer.

Prior to the lamination of the hard releasing layer 32, the surface of the base member 31 may be pre-treated by a known surface treating method, such as plasma, flame and UV ray irradiation.

The hard releasing layer 32 is not particularly limited, as long as it achieves the above-mentioned universal hardness Hu and exerts a releasing property to the toner, and may be prepared, for example, as an inorganic layer made from an inorganic material, or as an organic layer made from an organic material.

Specific examples of the inorganic layer include an inorganic oxide layer and the like. In the case when the hard releasing layer is prepared as an inorganic oxide layer, the hardness Hu can be controlled by adjusting film-forming reaction rate and ratio of amounts of added gases, upon film-forming by the plasma CVD process, which will be described later.

Specific examples of the organic layer include a hard carbon-containing layer and a cured resin layer. In the case when the hard releasing layer is prepared as a hard carbon-containing layer, the hardness Hu can be controlled by adjusting film-forming reaction rate and ratio of amounts of added gases, upon film-forming by the plasma CVD process, which will be described later. In the case when the hard releasing layer is prepared as a UV cured resin layer, the hardness Hu can be controlled by adjusting UV irradiation time, irradiation intensity and the like so as to control curing degree, as well as by adjusting mixing ratio of materials and mixing ratio of added materials.

The inorganic oxide layer preferably contains at least one oxide selected from $SiO_2$, $Al_2O_3$, $ZrO_2$ and $TiO_2$, and in particular, $SiO_2$ is preferably contained. The inorganic oxide layer is preferably manufactured by using a plasma CVD method in which a mixed gas containing at least a discharge gas and a material gas for an inorganic oxide layer is formed into plasma, so that a film is deposited and formed in accordance with the material gas, in particular, by using the plasma CVD method carried out under atmospheric pressure or under near atmospheric pressure. Not particularly limited, the thickness of the inorganic oxide layer is set to, for example, 1 μm or less, in particular, in the range from 10 to 100 nm.

By exemplifying a process in which an inorganic oxide layer using silicon oxide ($SiO_2$) is formed through an atmospheric pressure plasma CVD method, the following description will discuss the manufacturing apparatus and the manufacturing method thereof. The atmospheric pressure or pressure near the atmospheric pressure refers to a pressure in the range from 20 kPa to 110 kPa, and the pressure is preferably set in the range from 93 kPa to 104 kPa in order to obtain desirable effects described in the present invention.

Figure 7:
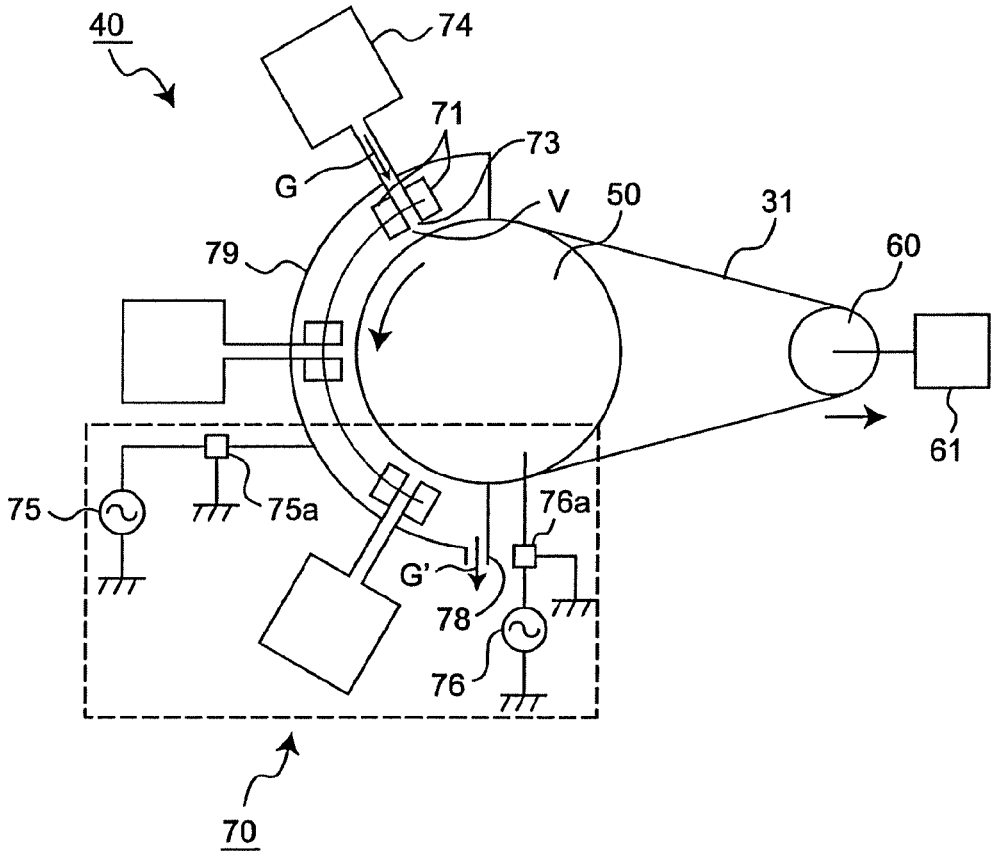
FIG. 7 is an explanatory drawing that shows a manufacturing device used for manufacturing the intermediate transfer member.

FIG. 7 is an explanatory drawing that shows a manufacturing apparatus used for forming the inorganic oxide layer. The manufacturing apparatus 40 of the inorganic oxide layer has a structure in which the discharging space and the thin-film depositing area are prepared as virtually the same portion, and by using a direct system in which the base member is exposed to plasma so as to carry out depositing and forming processes, the inorganic oxide layer is formed on the base member, and the manufacturing apparatus 40 is configured by a roll electrode 50 that rotates in an arrow direction with the base member 31 shaped into an endless belt being passed thereon, a driven roller 60 and an atmospheric pressure plasma CVD device 70 that is a film-forming device used for forming the inorganic oxide layer on the surface of the base member.

The atmospheric pressure plasma CVD device 70 is provided with at least one set of a fixed electrode 71, a discharging space 73 that forms an opposing area between the fixed electrode 71 and the roll electrode 50 and allows a discharging to be exerted therein, a mixed gas supplying device 74 that generates a mixed gas G of at least material gas and a discharge gas, and supplies the mixed gas G to the discharging space 73, a discharging container 79 that reduces an air flow entering the discharging space 73 or the like, a first power supply 75 connected to the fixed electrode 71, a second power supply 76 connected to the roll electrode 50 and an exhausting unit 78 used for exhausting the used exhaust gas G', which are placed along the periphery of the roll electrode 50. The second power supply 76 may be connected to the fixed electrode 71, and the first power supply 75 may be connected to the roll electrode 50.

The mixed gas supplying device 74 supplies a mixed gas containing a material gas used for forming a film containing silicon oxide, and a rare gas such as a nitrogen gas or an argon gas, to the discharging space 73.

The driven roller 60 is pressed in an arrow direction by a tension applying means 61, so that a predetermined tension is imposed on the base member 31. The tension applying means 61 releases the application of the tension, for example when the base member 31 is exchanged, so that, for example, the exchanging process of the base member 31 can be carried out easily.

The first power supply 75 outputs a voltage having a frequency ω1, and the second power supply 76 outputs a voltage having a frequency ω2 higher than the frequency ω1, so that an electric field V in which the frequencies ω1 and ω2 are multiplexed is generated in a discharging space 73 by these voltages. Thus, a mixed gas G is formed into plasma by the electric field V, so that a film (inorganic oxide layer) is deposited on the surface of the base member 31 in accordance with a material gas contained in the mixed gas G.

In another embodiment, of the roll electrode 50 and the fixed electrode 71, one of the electrodes may be connected to earth, with the other electrode being connected to a power supply. In this case, the second power supply is preferably used as a power supply, since a precise film-forming process is available, and this manner is preferably used, in particular, in the case when a rare gas such as argon gas is used as a discharge gas.

Among a plurality of fixed electrodes, those fixed electrodes positioned on the downstream side in the rotation direction of the roll electrode and a mixed gas supplying device may be used to deposit the inorganic oxide layers in a manner so as to be stacked, so that the thickness of the inorganic oxide layers may be adjusted.

Among a plurality of fixed electrodes, the fixed electrode positioned on the farthest downstream side in the rotation direction of the roll electrode and the mixed gas supplying device may be used to deposit the inorganic oxide layers, and the other fixed electrodes positioned on the upper stream side and the mixed gas supplying device may be used to deposit another layer, such as an adhesive layer used for improving the adhesive property between the inorganic oxide layer and the base member.

In order to improve the adhesive property between the inorganic oxide layer and the base member, a gas supplying device for supplying a gas such as an argon, oxygen or hydrogen gas and a fixed electrode are placed on the upstream of the fixed electrode and the mixed gas supplying device used for forming the inorganic oxide layer so as to carry out a plasma process, so that the surface of the base member may be activated.

Specific examples of the hard carbon-containing layer serving as the hard releasing layer 32 include an amorphous carbon film, a hydrogenated amorphous carbon film, a tetrahedron amorphous carbon film, a nitrogen-containing amorphous carbon film and a metal containing amorphous carbon film. The thickness of the hard carbon-containing layer is preferably set to the same thickness as that of the inorganic oxide layer.

The hard carbon containing layer may be manufactured by using the same method as the above-mentioned manufacturing method of the inorganic oxide layer; that is, it is manufactured by using a plasma CVD method in which at least a mixed gas of a discharge gas and a material gas is formed into plasma so that a film is deposited and formed in accordance with the material gas, in particular, by using the plasma CVD method carried out under atmospheric pressure or under near atmospheric pressure.

With respect to the material gas to be used for forming the hard carbon-containing layer, an organic compound gas, which is in a gaseous state or in a liquid state under normal temperature, in particular, a hydrogen carbide gas, is preferably used. The phase state of each of these materials is not necessarily a gaseous phase under normal temperature and normal pressure, and those having either a liquid phase or a solid phase may be used as long as they can be evaporated through fusion, evaporation or sublimation, by a heating process, a pressure-reducing process or the like carried out in the mixed gas supplying device. With respect to the hydrogen carbide gas serving as a material gas, a gas containing at least hydrogen carbide, such as paraffin-based hydrocarbons, like $CH_4$, $C_2H_6$, $C_3H_8$ and $C_4H_{10}$, acetylene-based hydrocarbon like $C_2H_2$ and $C_2H_4$, olefin-based hydrocarbon, diolefin-based hydrocarbon, and aromatic hydrocarbon, may be used. Other than hydrocarbons, for example, any compound may be used as long as it contains at least carbon elements, such as alcohols, ketones, ethers, esters, CO and $CO_2$.

The curable resin layer is a resin layer formed by coating a curable resin and curing this through heat or light rays (UV rays). With respect to the curable resin, known resins in the resin field that exert a curing property may be used, and examples thereof include acryl-based UV curable resin. Not particularly limited, the thickness of the curable resin layer is set, for example, in the range from 0.5 to 5 μm, preferably from 3 to 5 μm.

The curable resin is available as a commercial product.

For example, Sanrad (made by Sanyo Chemical Industries, Ltd.) may be used as an acryl-based UV-curable resin.

These intermediate transfer member 3 and latent-image supporting member 2 form a nip section (contact section), resulting in that the intermediate transfer member 3 presses the latent-image supporting member 2; therefore, for example, when a predetermined voltage is applied to the primary transfer roller, the toner image on the latent-image supporting member is transferred onto the surface thereof.

On the side opposite to the latent-image supporting member 2 with respect to the intermediate transfer member 3, normally, primary transfer rollers 4 (4*a*, 4*b*, 4*c*, 4*d*) are placed. The primary transfer rollers are preferably made of metal, such as iron and aluminum, or a rigid material such as a hard resin.

With respect to the extension rollers (10, 11), not particularly limited, for example, metal rollers, made of aluminum and iron, may be used. A roller having a structure in which a coating layer is formed on the peripheral face of a core metal member, with the coating layer being made by dispersing conductive powder and carbon in an elastic material such as EPDM, NBR, urethane rubber and silicone rubber, may be used, and the resistivity of this roller is adjusted to $1\times10^9$ Ω/cm or less.

With respect to the other members and devices installed in the image-forming apparatus of the present invention, that is, for example, a secondary transfer roller 5, a belt cleaning device 7, a charging device, an exposing device, a developing device and a cleaning device for the latent-image supporting member, not particularly limited, those known members and devices conventionally used in the image-forming apparatus may be used.

For example, with respect to the developing device, those having a mono-component developing system using only toner, or those having a two-component developing system using toner and carrier, may be used.

The toner may contain toner particles manufactured by a wet method such as a polymerization method or toner particles manufactured by a pulverizing method (dry method).

Not particularly limited, an average particle size of the toner is set to 7 μm or less, preferably in the range from 4.5 μm to 6.5 μcm. The smaller the toner average particle size, the higher the occurrence of void image becomes conspicuous at the time of a primary transferring process; however, the present invention makes it possible to effectively prevent the above-mentioned problem even when such a particle size is used. The toner is formed by externally adding inorganic fine particles (post treatment agent) to toner particles, and an amount of addition of the inorganic fine particles is preferably in the range of 0.5 to 4.0% by weight to the toner particles.

EXAMPLES

Production of Transfer Belts A1 to A6

A base member having a seamless shape, which was made from a PPS resin having carbon dispersed therein and had an average value of $1\times10^{10}$Ω/□ in surface resistivity and an average value of $1\times10^9$ Ω·cm in volume resistivity, with a thickness of 0.15 mm, was obtained by using an extrusion-molding process.

The outer circumferential surface of the base member was coated with an acryl-based UV-curable resin, and this was cured by irradiation with UV rays, so that a cured resin layer having a film thickness of 3 μm was formed; thus, each of transfer belts A1 to A6 was obtained. The transfer belts A1 to A6 were controlled to have a universal hardness in the range from about 160 to 390 N/mm$^2$, by adjusting the UV irradiation time and irradiation intensity.

Production of Transfer Belt B1

A base member having a seamless shape, which was made from a polyimide resin having carbon dispersed therein and had an average value of $1\times10^{11}$Ω/□ in surface resistivity and an average value of $1\times10^9$ Ω·cm in volume resistivity, with a thickness of 0.15 mm, was obtained by using an extrusion-molding process. This base member was used as a transfer belt B1 as it was. The universal hardness thereof was about 195 N/mm$^2$.

Production of Transfer Belt C1

A base member having a seamless shape, which was made from a PPS resin having carbon dispersed therein and had an average value of $1\times10^{10}$Ω/□ in surface resistivity and an average value of $1\times10^9$ Ω·cm in volume resistivity, with a thickness of 0.15 mm, was obtained by using an extrusion-molding process. This base member was used as a transfer belt C1 as it was. The universal hardness thereof was about 140 N/mm$^2$.

Production of Transfer Belt D1

A base member having a seamless shape, which was made from a PPS resin having carbon dispersed therein and had an average value of $1\times10^{10}\Omega/\square$ in surface resistivity and an average value of $1\times10^{9}$ Ω·cm in volume resistivity, with a thickness of 0.15 mm, was obtained by using an extrusion-molding process.

A $SiO_2$ thin-film layer having a film thickness of 200 nm was formed on the outer circumferential face of the base member by a plasma CVD method under atmospheric pressure, so that a transfer belt D1 was obtained. This had a hardness Hn of 4.5 GPa measured by a nano-indentation method, and when converted to the universal hardness, the hardness was 940 N/mm$^2$.

Experimental Example 1

Figure 8:
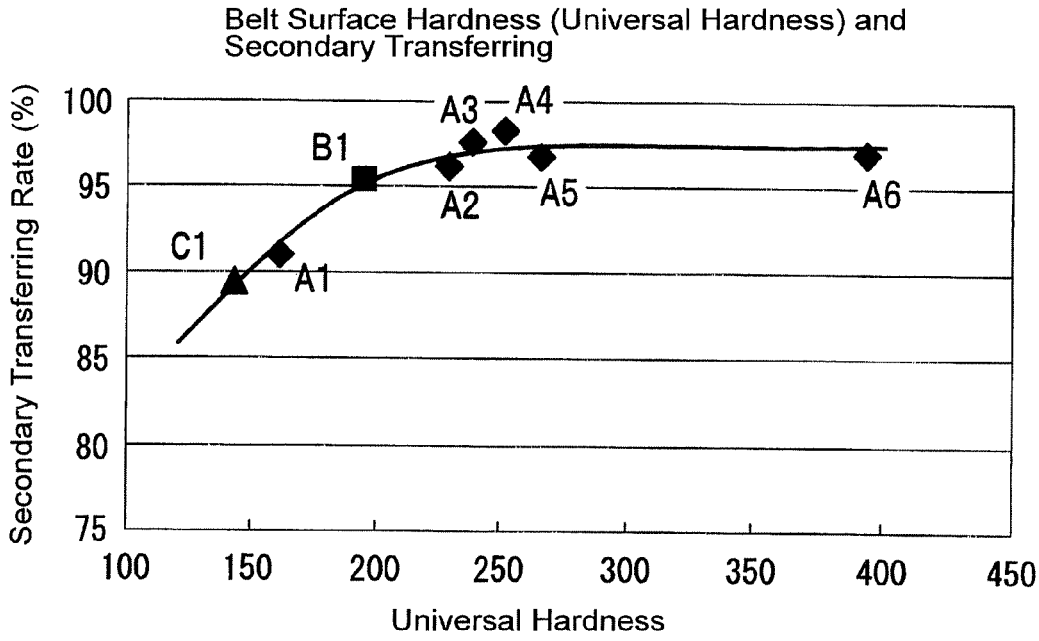
FIG. 8 is a graph that shows the relationship between the universal hardness and the secondary transferring rate, formed based upon Experimental Example 1.
Figure 9:
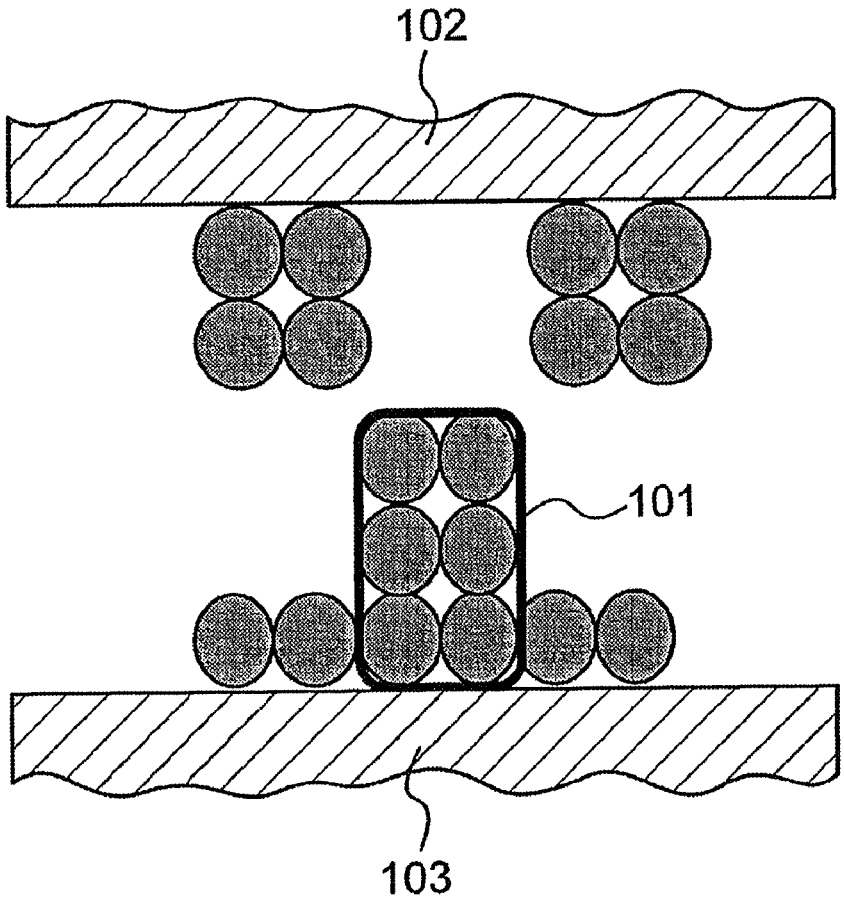
FIG. 9 is a schematic drawing that explains mechanism by which a void image is generated due to toner aggregation.

Bizhub C350 (made by Konica Minolta Technologies, Inc.) having a structure shown in FIG. 1 was equipped with each of the transfer belts A1 to A6, B1 and C1, and a printing process of a solid image in a red color formed by superposing two colors of cyan and magenta was carried out, and the secondary transferring rate was measured. The toner was formed by externally adding 2.5% by weight of inorganic fine particles (post treatment agent) to toner particles, and the universal hardness of the surface of the photosensitive member was 240 N/mm$^2$. FIG. 8 shows the relationship between the universal hardness and the secondary transferring rate of the transfer belt. The secondary transferring rate is a value calculated by an expression (toner amount transferred to the image-receiving member after the secondary transferring process/toner amount on the intermediate transfer belt prior to the secondary transferring process)×100 [%], and as the value becomes greater, the releasing property of the transfer belt becomes more superior. FIG. 8 shows that the hardness of a transfer belt, which achieves a secondary transferring rate of 97% or more that is a permissible level in practical use, is 220 N/mm$^2$ or more.

Experimental Example 2

Bizhub C350 (made by Konica Minolta Technologies, Inc.) having a structure shown in FIG. 1 was equipped with each of the transfer belts A5, A6, D1 and C1, and continuous printing operations of 10,000 sheets by using a character image (A-4 size) having a print rate of 5% in each of colors, and the resulting prints were evaluated on the following items. The peripheral speed of the intermediate transfer belt was set to 166 mm/s, with the number of revolutions of the motor used for driving the photosensitive member being changed so that each of predetermined speed rates Rv was achieved, and evaluation was made on each of the conditions.

Filming

The surface of the transfer belt was observed and visually evaluated after the continuous printing operations.

○: No filming occurred on the transfer belt due to a toner post-treatment agent; and x: Filming occurred on the transfer belt due to the toner post-treatment agent.

Void Image

After the continuous printing operations, an image with fine lines was printed, and the printed image was observed and visually evaluated. The evaluation was carried out based upon void image ranks of 9 stages with rank 1 (bad) to rank 5 (best) having 0.5 intervals. The range from rank 3 or more is a range that causes no problems in practical use, and the range from rank 4 or more is a preferably range.

Scratches

After the continuous printing operations, a mono-color half-tone image (gradations: 64) was printed, and the printed image was evaluated as to whether or not any image loss occurred due to scratches on the photosensitive member.

○: No image loss occurred; and x: Image loss occurred.

Secondary Transferring Rate

After the continuous printing operations, the secondary transferring rate was measured.

○: 97% or more; and x: Less than 97%.

TABLE 1

| Transfer belt A5: Hardness 265 N/mm$^2$ | | | | | | | |
|---|---|---|---|---|---|---|---|
| | Speed ratio Rv | | | | | | |
| | 1.0070 | 1.0080 | 1.0100 | 1.0120 | 1.0145 | 1.0150 | 1.0160 |
| Filming | X | ○ | ○ | ○ | ○ | ○ | ○ |
| Void image | 3 | 3 | 4 | 4 | 4.5 | 4.5 | 4.5 |
| Scratches | ○ | ○ | ○ | ○ | ○ | ○ | X |
| Secondary transferring rate | ○ | ○ | ○ | ○ | ○ | ○ | ○ |

TABLE 2

| Transfer belt A6; Hardness 390 N/mm$^2$ | | | | | | |
|---|---|---|---|---|---|---|
| | Speed ratio Rv | | | | | |
| | 1.0050 | 1.0070 | 1.0100 | 1.0120 | 1.0145 | 1.0150 |
| Filming | X | ○ | ○ | ○ | ○ | ○ |
| Void image | 3 | 3 | 4 | 4 | 4.5 | 4.5 |
| Scratches | ○ | ○ | ○ | ○ | ○ | X |
| Secondary transferring rate | ○ | ○ | ○ | ○ | ○ | ○ |

TABLE 3

| Transfer belt D1: Hardness 940 N/mm$^2$ | | | | | | | | | |
|---|---|---|---|---|---|---|---|---|---|
| | Speed ratio Rv | | | | | | | | |
| | 1.0035 | 1.0040 | 1.0050 | 1.0070 | 1.0090 | 1.0100 | 1.0115 | 1.0120 | 1.0125 |
| Filming | X | ○ | ○ | ○ | ○ | ○ | ○ | ○ | ○ |
| Void image | 2.5 | 3 | 3 | 3.5 | 4 | 4 | 4.5 | 4.5 | 5 |
| Scratches | ○ | ○ | ○ | ○ | ○ | ○ | ○ | ○ | X |
| Secondary transferring rate | ○ | ○ | ○ | ○ | ○ | ○ | ○ | ○ | ○ |

TABLE 4

| Transfer belt C1: Hardness 140 N/mm$^2$ | | | | | | | | | |
|---|---|---|---|---|---|---|---|---|---|
| | Speed ratio Rv | | | | | | | | |
| | 1.0050 | 1.0070 | 1.0080 | 1.0100 | 1.0115 | 1.0120 | 1.0125 | 1.0160 | 1.0170 |
| Filming | X | X | ○ | ○ | ○ | ○ | ○ | ○ | ○ |
| Void image | 3.5 | 4 | 4 | 4.5 | 4.5 | 4.5 | 4.5 | 4.5 | 4.5 |
| Scratches | ○ | ○ | ○ | ○ | ○ | ○ | ○ | ○ | X |
| Secondary transferring rate | X | X | X | X | X | X | X | X | X |

General Evaluation

The above-mentioned results of evaluation were comprehensively evaluated, and the relationship among the universal hardness, the speed ratio and the general evaluation was shown in FIG. 2.

In FIG. 2, black dots mean the most superior results having '○' in any of the results of the filming, scratches and secondary transferring rate, with the result of the void image being rank 4 or more.

White dots mean good results in a level causing no problems in practical use, which have '○' in any of the results of the filming, scratches and secondary transferring rate, with the result of the void image being in the range from rank 3 or more to less than rank 4.

Symbols 'x' mean that at least one of the results of the filming, scratches and secondary transferring rate was "x" or that the results of the void image was less than 3.

What is claimed is:

1. An image-forming apparatus comprising:

a latent-image supporting member, and an intermediate transfer member that supports a toner image primarily-transferred thereon from the latent-image supporting member, secondarily-transfers the supported toner image onto an image receiving medium, and has a hard releasing layer on the surface thereof, and a ratio Rv (Vbt/Vpc) between a surface moving speed Vbt of the intermediate transfer member and a peripheral speed Vpc of the latent-image supporting member satisfies the following relational expression:

$$-5\times10^{-6}\times Hu+1.0087 \leqq Rv \leqq -5\times10^{-6}\times Hu+1.0167$$

wherein Hu is a universal hardness (N/mm$^2$) of the surface of the intermediate transfer member, and is set to 220 N/mm$^2$ or more.

2. The image-forming apparatus of claim 1, wherein the universal hardness of the surface of the intermediate transfer member is set in the range from 220 to 1100 N/mm$^2$.

3. The image-forming apparatus of claim 1, wherein the hard releasing layer is an inorganic layer.

4. The image-forming apparatus of claim 1, wherein the hard releasing layer is an organic layer.

5. The image-forming apparatus of claim 1, wherein the intermediate transfer member has a seamless belt shape.

6. The image-forming apparatus of claim 1, wherein the intermediate transfer member comprises a base member and the hard releasing layer, and the base member has a volume resistivity in the range from $1\times10^6$ Ω/cm to $1\times10^{12}$ Ω/cm and a surface resistivity in the range from $1\times10^7$Ω/□ to $1\times10^{12}$Ω/□.

7. The image-forming apparatus of claim 1, wherein the intermediate transfer member comprises a base member and the hard releasing layer, and the base member comprises a resin material and has a thickness of 50 to 200 μm.

8. The image-forming apparatus of claim 1, wherein the intermediate transfer member comprises a base member and the hard releasing layer, and the base member comprises a rubber material and has a thickness of 300 to 700 μm.

9. The image-forming apparatus of claim 3, wherein the inorganic layer is an inorganic oxide layer.

10. The image-forming apparatus of claim 9, wherein the inorganic oxide layer comprises $SiO_2$.

11. The image-forming apparatus of claim 4, wherein the organic layer is a hard carbon-containing layer.

12. The image-forming apparatus of claim 4, wherein the organic layer is a cured resin layer.

13. The image-forming apparatus of claim 1, wherein a toner which is used to form the toner image has an average particle size of 7 μm or less.

* * * * *